US006104265A

United States Patent [19]

Maloney et al.

[11] Patent Number: 6,104,265

[45] Date of Patent: Aug. 15, 2000

[54] MINIATURE CIRCUIT BREAKER WITH MULTIPURPOSE AUXILIARY MEMBER

[75] Inventors: James Gerard Maloney, Industry; Ronald Dale Smiddle, Canonsburg, both of Pa.

[73] Assignee: Eaton Corporation, Cleveland, Ohio

[21] Appl. No.: 09/026,279

[22] Filed: Feb. 19, 1998

[51] Int. Cl.[7] ..... H01H 73/12; H01H 9/00; H01H 75/00

[52] U.S. Cl. ..... 335/13; 200/308; 335/17; 335/132

[58] Field of Search ..... 200/50.32–50.4, 200/DIG. 6, 307, 308; 335/8–10, 17, 18, 132, 11–16

[56] References Cited

U.S. PATENT DOCUMENTS

| | | | |
|---|---|---|---|
| 3,789,169 | 1/1974 | Yazvac | 200/50.33 |
| 3,840,833 | 10/1974 | Mrenna et al. | 200/50.32 X |
| 4,166,988 | 9/1979 | Clarcia et al. | 200/50.4 X |
| 4,209,761 | 6/1980 | Klein et al. | 335/17 |
| 4,933,653 | 6/1990 | Mrenna et al. | 335/37 |
| 5,001,315 | 3/1991 | Runyan et al. | 200/307 |
| 5,008,645 | 4/1991 | Mrenna | 337/70 |
| 5,107,236 | 4/1992 | Lesslie et al. | 335/132 |
| 5,483,211 | 1/1996 | Carrodus et al. | 335/18 |
| 5,552,755 | 9/1996 | Felio et al. | 335/18 |

*Primary Examiner*—J. R. Scott
*Attorney, Agent, or Firm*—Martin J. Moran

[57] ABSTRACT

Miniature circuit breaker apparatus is taught which includes side-by-side ganged cases where one of the ganged cases includes the main circuit breaker operating mechanism and contacts and where the other case includes an actuable micro-switch, which is interconnected with an indicating device for providing either a bell alarm function for the circuit breaker system or an auxiliary switch function for the circuit breaker system. The bell alarm function is provided by extending the rotatable axis of the trip mechanism of the main circuit breaker into the case of the secondary circuit breaker casing for movement of an auxiliary switch. The auxiliary switch indicates a trip function when the main circuit breaker contacts have been tripped opened, thus providing a bell alarm indication, for example. The handles of the two circuit breaker cases are also tied together, so that when the circuit breaker mechanism of the first casing is opened, the handles of the second casing are moved in conjunction therewith to also actuate the auxiliary switch by the separate actuating mechanism located in the second enclosure to provide an auxiliary switch indication that the contacts of the main circuit breaker portion are opened. Common circuit breaker components are available for use in either case, but only those components are actually utilized for the function desired.

12 Claims, 3 Drawing Sheets

MINIATURE CIRCUIT BREAKER WITH MULTIPURPOSE AUXILIARY MEMBER

BACKGROUND OF THE INVENTION

1. Field of the Invention

The subject matter of this invention is related in general to miniature circuit breakers and more particularly to add-on devices, such as auxiliary switches and bell alarms.

2. Description of the Prior Art

Miniature circuit breakers are well known in the art. An example of such can be found in U.S. Pat. No. 4,933,653 entitled Circuit Breaker with Low Current Magnetic Trip issued Jun. 12, 1990 to Mrenna et al., and assigned to the assignee of the present application. It is also well known in the art to use side-by-side ganged miniature circuit breaker cases, to provide auxiliary functions for the main circuit interrupting mechanism. Such an example can be found in U.S. Pat. No. 5,483,211 entitled Two-Pole Compartmentalized Ground Fault Miniature Circuit Breaker with Single Central Electronics Compartment by Carrodus et al., issued Jan. 9, 1996 and assigned to the assignee of the present applications. It is also known to utilize a common case which can accommodate either the main circuit interrupter components or the auxiliary components.

It would be desirous to find a molded case circuit breaker having the features described previously, but in which the auxiliary components which are disposed within the circuit breaker casing may be utilized for different auxiliary circuit breaker functions with only slight modification.

SUMMARY OF THE INVENTION

In accordance with the invention a circuit breaker system is taught with a circuit breaker having a first enclosure with separable main contacts disposed within the first enclosure. Also disposed within are a trip shaft and an operating mechanism for operating the trip shaft for causing the separable main contacts to open and close. A handle extends outwardly from the first enclosure for movement to an off position in response to an off condition for the separable main contacts. There is also provided a second enclosure disposed in proximity to the first enclosure for containing there within an auxiliary function device for the circuit breaker. The second enclosure has a receiver for receiving the trip shaft of the circuit breaker therein. The trip shaft moves inside the second enclosure in correspondence with its movement to the tripped position in the first enclosure to actuate the auxiliary function device within the second enclosure. The auxiliary function device once actuated provides an indication of a trip operation for the separable main contact. The second enclosure has a trip handle similar to that of the first enclosure. Both trip handles are mechanically ganged for common movement. The auxiliary switch may be thus also actuated by the combined movement of the handles when the first circuit interrupter is opened, thus providing an auxiliary switch indication.

BRIEF DESCRIPTION OF THE DRAWINGS

For a better understanding of the invention reference may be had to the preferred embodiment thereof shown in the accompanying drawings in which.

DESCRIPTION OF THE PREFERRED EMBODIMENT

Figure 1:
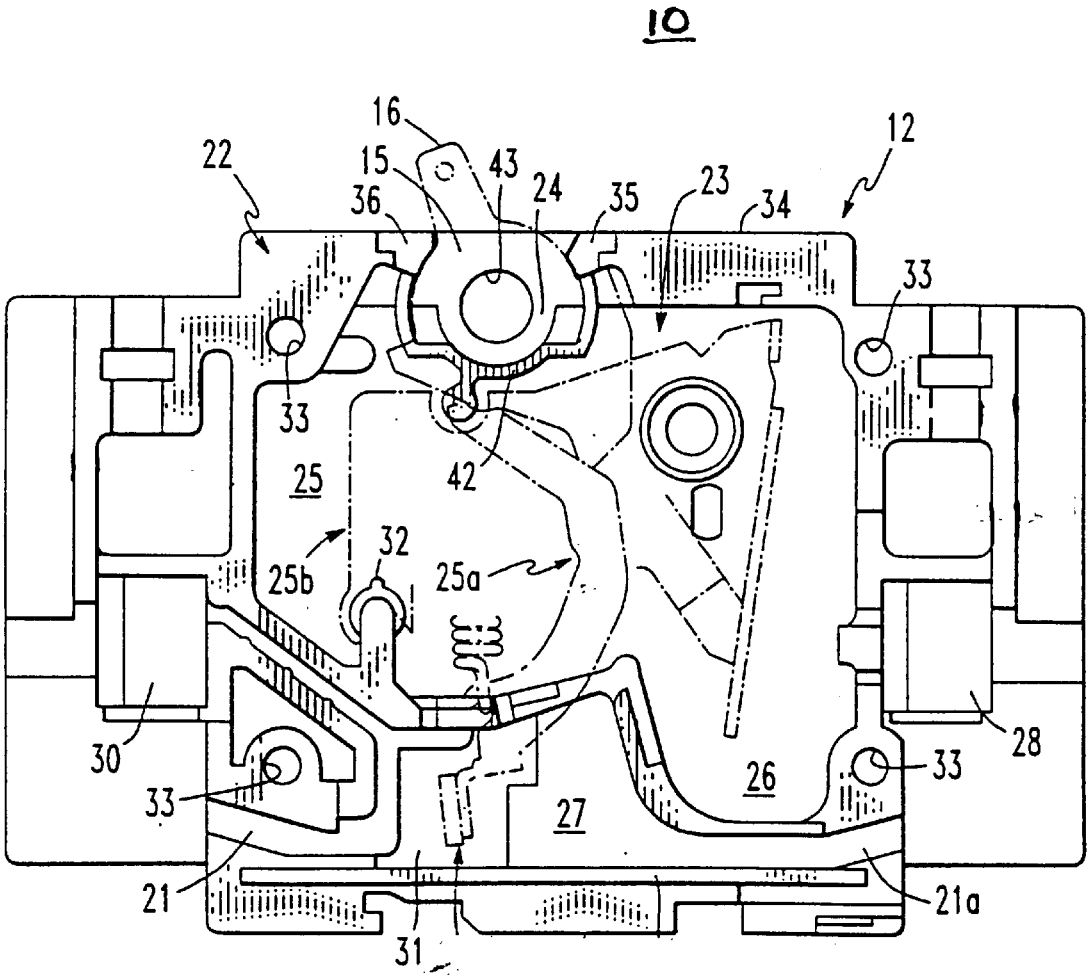
PRIOR ART FIG. 1
FIG. 1 shows an elevation of a prior art molded case circuit breaker, with one side removed to depict the internal construction features of the case of the prior art circuit breaker.

FIG. 1 illustrates the base 12 of a prior art circuit breaker 10 before the components of the circuit breaker mechanism are installed. Base 12 is a molded one-piece member with an integrally formed raised ribbing system 22 which, as is know in the art, generally forms a cavity for the circuit breaker mechanism and includes portions for support and/or forming different compartments or areas such as those indicated at 24, 25, 26, 27, 28, 30 and 31 for receiving and positioning the several components of a circuit breaker mechanism. For instance, the arcuate area 24 positions the handle part 16. Area 25 positions a latchable operating mechanism (not shown) which is spring biased to the handle part 16 and a stationary support plate which is supported on post 32 which is part of ribbing system 22. Compartment 26 supports a cradle (not shown). Areas 28 and 30 position the load and line electrical terminals (shown in phantom) for the load and line terminals respectively. Area 31 receives a set of electrical contacts (not shown) for the load and line terminals. These and other components of the circuit breaker mechanism may be assembled and placed in the several areas formed by the ribbing system in a manner similar to that shown in U.S. Pat. Nos. 4,933,653, 5,008,645 and 5,483,211 which are assigned to the same assignee at this application. These U.S. patents are incorporated herein by reference.

Ribbing system 22 also forms channels 21 and 21*a* for the escape of gases into the atmosphere, and includes outer peripheral walls which essentially form main cavity 23 for the circuit breaker mechanism, and which contain apertures 33 for receiving rivets. Handle part 16 protrudes from peripheral wall 34 through a generally rectangular opening or aperture 15. Located inwardly of peripheral wall 34 and aperture 15 is a rib portion 42 which is a barrier member which receives and overlaps a portion of the handle part 16 when handle part 16 is placed into arcuate area 24. Barrier member 42 is generally arcuate and borders arcuate area 24, which, in turn, has a circular coring 43. This arcuate area 24 and coring 43 corresponds to a bearing surface of handle part 16.

Handle part 16 fits fully into and is adequately supported by aperture 15 in base 12. Base 12 may be made of a glass polymer material or a plastic material.

Figure 2:
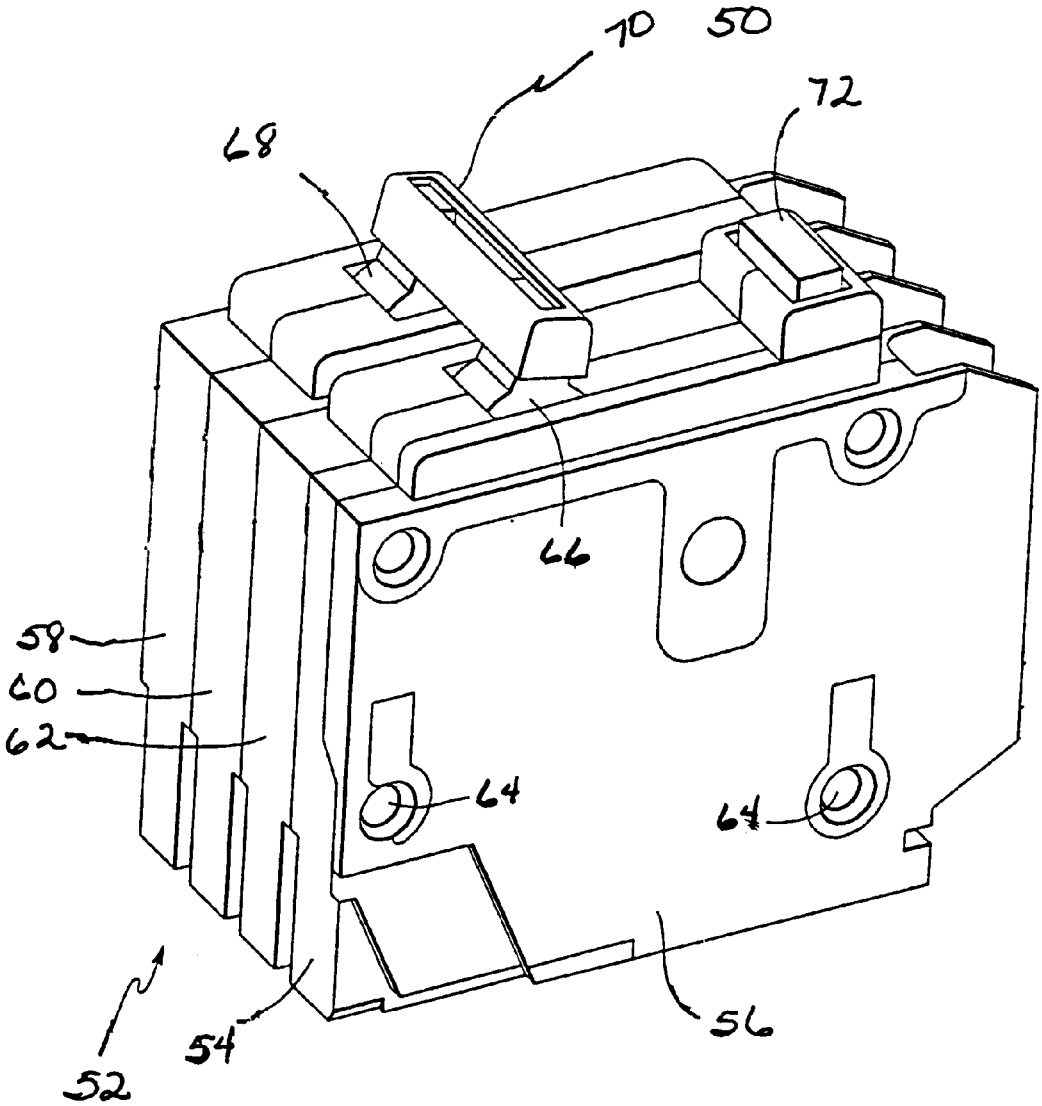
Fig. 2 PRIOR ART
FIG. 2 shows an orthogonal view of a prior art molded case circuit breaker ganged in side-by-side relationship with commonly tied handles.

Referring to FIG. 2 a two-pole circuit breaker 50 comprises a housing 52. The housing 52 is molded in sections from an electrically insulating material such as a thermal setting resin. The sections of the housing 52 includes a top base 54, a top cover 56, a bottom cover 58, a bottom base 60 and a hollow center base 62, all secured together such as by rivets 64. Each of the poles of the circuit breaker has an operating handle 66 and 68 which may be operated in unison by way of the handle tie 70. In addition, the operation of the circuit breaker 2 can be tested by depressing the test button 72.

The prior art circuit breaker combination of FIG. 2 is the kind shown and described in previously described U.S. Pat. No. 5,483,211. In particular this arrangement is shown for the purpose of clarifying that circuit breaker pole arrangements may be jointed in side-by-side relationship to form multi-pole operation. In addition the handles 70 may be tied together, so that both are forced to move together. This may occur when one is automatically moved, in which case the other will follow. In the arrangement shown in FIG. 2, not only is it possible to have two identical circuit breaker subparts, tied together in side-by-side relationship. But one of the circuit breaker cases may contain a different set of functional elements than the other. In this particular prior art embodiment the circuit breaker comprises a ground fault circuit interrupter in which ground fault functionality is provided by one of the circuit breaker cases and circuit interruption capability is provided by the other case. It is to be noted that the shape of the circuit interrupter casing is slightly different than that shown in FIG. 1. However, it is to be expected that the circuit breaker mechanisms are very similar although that is not to be considered as limiting.

Figure 3:
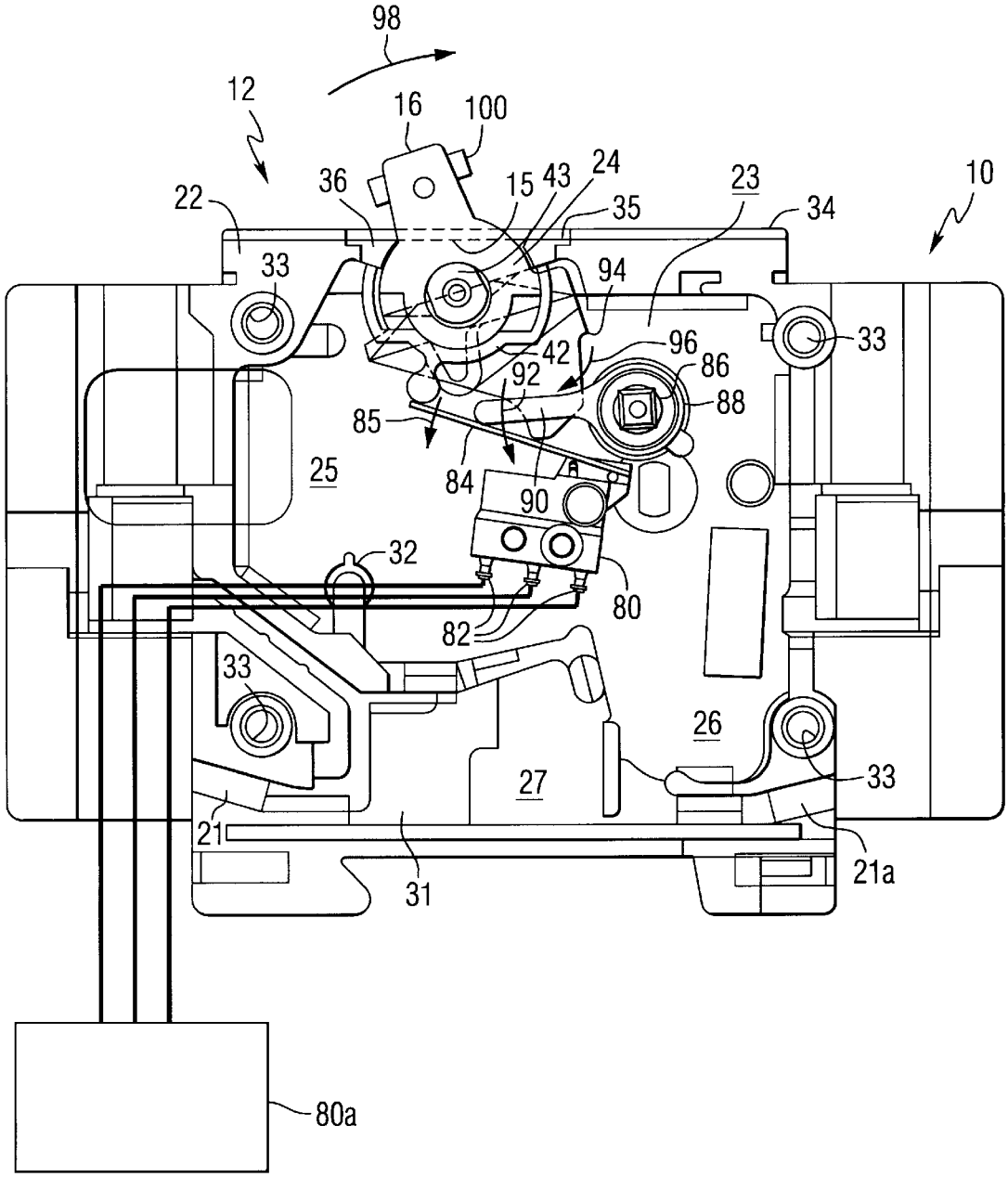
FIG. 3 shows an arrangement similar to that shown in to FIG. 1, but with embodiments of the present invention disposed therein.

Referring now to FIG. 3 an embodiment of the present invention is shown in which some of the characteristics of the circuit breaker arrangement of FIG. 1 are utilized and some of the characteristics of the circuit breaker arrangement of FIG. 2 are utilized, but in which new circuit breaker functionality is provided in accordance with the teachings of the present invention. In particular the circuit breaker case 12 of the circuit breaker of FIG. 3 is similar or the same as that of the circuit breaker shown in prior art arrangement of FIG. 1. In the preferred embodiment of the invention two circuit breaker cases, are deposed in side-by-side relationship, such as is depicted in FIG. 2. In one embodiment of the invention the circuit breaker includes all of the circuit breaker elements previously described with respect to FIG. 1 and more adequately described in U.S. Pat. No. 5,436,604 which is incorporated by reference herein. One of the inventive characteristics of the invention depicted in FIG. 3 is that the same circuit breaker case may be utilized in one part of the tandem arrangement, but without the circuit breaker components disposed therein. Rather new and useful components are disposed therein which provide other functions for the co-joined circuit breaker elements. In the embodiments shown in FIG. 3, like reference symbols refer to like elements with respect to the description of the device shown in FIG. 1. In this case thought rather than circuit interrupter, parts being disposed within the internal portion of the circuit interrupter, other apparatus is provided for, in turn, providing an auxiliary switch and/or bell alarm arrangement. The same pieces of circuit breaker equipment may be used both for bell alarm function or auxiliary switch function.

In particular there is provided an auxiliary switch or switch 80 which may be a micro switch or the like and which may have three terminals 82 which are inter-connectable with electrical leads for providing an output signal indicative of the status of the switch bar arrangement 84. When the switch bar arrangement 84 is in the disposition shown in FIG. 3, the switch arrangement provides one indication to the outside or remote location and when the switch bar 84 has been moved in the direction 85 to change the switching arrangement within the switch 80 a different arrangement is depicted externally of the switch 80. One of the inventive characteristics of the present invention is that either of two actuating instrumentalities may be utilized to change the disposition of the bar 84. In one case there is provided on a rotatable axial shaft 86, an electrically insulating triggering device 88 having an elongated cam member 90 which may be utilized when the shaft 86 causes the member 90 to rotate in the direction 92 to cause the bar 84 to move in the direction 85 to provide an indication of status change. The shaft 86 protrudes through an opening in the side wall of the circuit breaker 12 and into the adjacent chamber where it acts as a trip bar for electrical contacts contained within that cell of the circuit breaker arrangement. Consequently when the latter cell is activated to go into a trip operation, the shaft 86 is moved in the direction 92, the separable main contacts (not shown) in the adjacent circuit breaker cell will open and the rigidly fixed member 88 will rotate in the direction 92 thus actuating the switch 80 to cause an indication to be provided externally of the open status of the circuit breaker contacts. On the other hand, there is shown a handle tie arrangement 100 similar to that shown at 70 in FIG. 2, which interconnects the handle 16 with a similar handle not shown in the parallel cell of the circuit breaker arrangement (also not shown). If the circuit breaker mechanism of the active cell is opened such as may occur when the handle is moved in the direction 98. Common tie-in member 100 will cause handle 16 to also move in direction 98, to cause the peninsula portion 94 of the handle 16 to move in a direction 96 to once again cause the switch actuating bar member 84 to move in the direction 85 to again provide an indication externally of the circuit breaker that circuit breaker has opened. Consequently it can be seen that the arrangement depicted in FIG. 3 may be used after some modest adjustment as either a provider of an indication of circuit tripping or circuit turnoff as the case may be. This can be done without the need of manufacturing separate circuit breaker joining cell components. For instance, if the component 12 shown in FIG. 3 is to be used as a bell alarm device, that is a device which indicates when the circuit breaker has been tripped, reliance is conditioned on the shaft 86 rotating in the direction 92 as will naturally occur when the separable main contacts of the adjacent cell circuit breaker trips open. In this case the peninsular region 94 of the switch 16 is deleted or removed from the switch handle so that it will provide no function. Rotation of the shaft 86 in a different direction corresponding to a closing once again of the circuit breaker contacts will cause the molded member 88 to rotate in the counter direction 92 allowing the arm 84 to move in the counter direction 85 to thus once again change the status of the switch 80. Bell alarm 80*a*, which may be remote or local is interconnected with terminals 82 to be activated by switch 80 at an appropriate time. If on the other hand it is merely necessary to know when the circuit breaker has been turned off, reliance will be placed on the handle tie arrangement 100 and its ability to tie-in the two handles 16 to cause the now present peninsular region 94 to rotate in the direction 96 to cause the switch 80 to actuate to show that the contacts have been closed. Of course the opposite occurs when the handle 16 is moved in a counter direction 98 as will occur when the switch is opened.

Which specific embodiments of the invention has been described in detail, it will be appreciated by those skilled in the art that various modifications and alternatives to those details could be developed in light of the overall teachings of the disclosure. Accordingly, the particular arrangements disclosed are meant to be illustrative only and not limited as to the scope of the invention which is to be given the full breadth of the appended claims and any and all equivalents thereof.

In accordance with the provisions of the patent statutes, we have explained the principle and operation of our invention and have illustrated and described what we consider to be the best embodiment thereof.

What we claim as our invention is:

1. A circuit breaker system, comprising;

first circuit breaker molded case of first molded geometry;

separable main contact means disposed within said first circuit breaker molded case for opening or closing;

trip shaft means, extending outwardly from said first circuit breaker molded case, for movement to a tripped position in response to a trip operation for said separable main contact means;

handle means, extending outwardly from said first circuit breaker molded case, for movement to a tripped position in response to a trip operation for said separable main contact means;

a second separate circuit breaker molded case having the same molded geometry as said first circuit breaker molded case for containing therewithin auxiliary function means, said second circuit breaker molded case having receiving means for receiving said trip shaft means therein and for moving in correspondence with said movement to said tripped position in response to a trip operation for said separable main contact means to actuate said auxiliary function means, said second separate circuit breaker molded case having no separate main contact means disposed therein; and said auxiliary function means, once actuated, providing an indication of said trip operation for said separable main contact means.

2. The combination as claimed in claim 1, wherein said auxiliary function means comprises alarm means.

3. The combination as claimed in claim 2, wherein said alarm means provides indication of said trip operation.

4. The combination as claimed in claim 3, wherein said alarm means is remotely located to provide remote indication of said trip operation.

5. A circuit breaker system, comprising;

a first circuit breaker molded case of first molded geometry;

separable main contact means disposed within said first circuit breaker molded case for opening or closing;

trip shaft means, extending outwardly from said first circuit breaker molded case, for movement to a tripped position in response to a trip operation for said separable main contact means;

first handle means, extending outwardly from said first circuit breaker molded case, for movement to an off position in response to an off condition for said separable main contacts means;

a second separate circuit breaker molded case having the same molded geometry as said first circuit breaker molded case disposed in proximity to said first circuit breaker molded case for containing therewithin auxiliary function means, said second circuit breaker molded case having second handle means extending therefrom in a disposition of mechanically interconnection with said first handle means for moving in correspondence with said movement of said first handle means to a position in response to an off condition for said separable main contacts means, said second separate circuit breaker molded case having no separate main contact means disposed therein;

said second handle means being mechanically intractable with said auxiliary function means to actuate said auxiliary function means; and said auxiliary function means, once actuated, providing an indication of said open status of said separable main contact means.

6. The combination as claimed in claim 5, wherein said auxiliary function means comprises an auxiliary switch.

7. The combination as claimed in claim 6, wherein said auxiliary switch is electrically interconnected to indicator means for providing indication of said separable main contact open status.

8. The combination as claimed in claim 7, wherein said auxiliary switch is electrically interconnected remotely to said indicator means for providing remote indication of said separable main contact open status.

9. A circuit breaker system comprising:

a first circuit breaker molded case of first molded;

separable main contact means disposed within said first circuit breaker molded case for opening or closing;

trip shaft means, extending outwardly from said first circuit breaker molded case for movement to a tripped position in response to a trip operation for said separable main contact means;

handle means, extending outwardly from said first circuit breaker molded case, for movement to an off position in response to an off condition for said separable main contacts means;

a second separable circuit breaker molded case having the same molded geometry as said first circuit breaker molded case disposed in proximity to said first circuit breaker molded case for containing therewithin auxiliary function means, said second circuit breaker molded case having receiving means for receiving said trip shaft means therein and for moving in correspondence with said movement to said tripped position in response to a trip operating for said separable main contact means to actuate said auxiliary function means, said second circuit breaker molded case having second handle means extending therefrom in a disposition of mechanically interconnection with said first handle means for moving in correspondence with said movement of said first handle means to a position in response to an off condition for said separable main contacts means, said second handle means being mechanically interactive with said auxiliary function means to actuate said auxiliary function means, said second separate circuit breaker molded case having no separable main contact means disposed therein; and said auxiliary functions means, once actuated by said trip shaft means, providing an indication of said trip operation for said separable main contact means, said auxiliary function means, once actuated by said second handle means, providing an indication of said open status of said separable main contact means.

10. The combination as claimed in claim 9, wherein said auxiliary function means comprises an auxiliary switch.

11. The combination as claimed in claim 10, wherein said auxiliary switch is electrically interconnected to indicator means for providing indication of said trip operation or said separable main contact open status.

12. The combination as claimed in claim 11, wherein said auxiliary switch is electrically interconnected remotely to said indicator means for providing remote indication of said trip operation or said separable main contact open status.

* * * * *